US011381041B2

(12) United States Patent
Xu et al.

(10) Patent No.: US 11,381,041 B2
(45) Date of Patent: Jul. 5, 2022

(54) ELECTRICAL CONNECTOR WITH IMPROVED SHIELDING EFFECT

(71) Applicant: DONGGUAN LEADER PRECISION INDUSTRY CO., LTD., Dongguan (CN)

(72) Inventors: Hongqiang Xu, Dongguan (CN); Lijun Xu, Dongguan (CN); Yong Wang, Dongguan (CN)

(73) Assignee: DONGGUAN LEADER PRECISION INDUSTRY CO., LTD., Dongguan (CN)

( * ) Notice: Subject to any disclaimer, the term of this patent is extended or adjusted under 35 U.S.C. 154(b) by 13 days.

(21) Appl. No.: 17/150,084

(22) Filed: Jan. 15, 2021

(65) Prior Publication Data

US 2021/0226387 A1 Jul. 22, 2021

(30) Foreign Application Priority Data

Jan. 20, 2020 (CN) ..... 202020136363.9

(51) Int. Cl.

| | |
|---|---|
| ***H01R 13/6595*** | (2011.01) |
| ***H01R 13/6597*** | (2011.01) |
| ***H01R 13/6581*** | (2011.01) |
| ***H01R 107/00*** | (2006.01) |
| ***H01R 24/60*** | (2011.01) |

(52) U.S. Cl.

CPC ..... *H01R 13/6595* (2013.01); *H01R 13/6581* (2013.01); *H01R 13/6597* (2013.01); *H01R 24/60* (2013.01); *H01R 2107/00* (2013.01)

(58) Field of Classification Search

CPC ..... H01R 13/6595; H01R 13/6581; H01R 13/6593; H01R 13/6597; H01R 24/60; H01R 2107/00

See application file for complete search history.

(56) References Cited

U.S. PATENT DOCUMENTS

| | | | | |
|---|---|---|---|---|
| 9,660,399 | B2 * | 5/2017 | Hsu | H01R 13/6594 |
| 2016/0149350 | A1 * | 5/2016 | Kao | H01R 12/724 439/607.05 |
| 2017/0033507 | A1 * | 2/2017 | Tsai | H01R 24/62 |
| 2017/0077651 | A1 * | 3/2017 | Chang | H01R 13/6581 |

* cited by examiner

*Primary Examiner* — Oscar C Jimenez

(74) *Attorney, Agent, or Firm* — Birch, Stewart, Kolasch & Birch, LLP

(57) ABSTRACT

The present disclosure discloses an electrical connector including an insulating body, a plurality of conductive terminals, a shielding shell and an outer metal shell. The insulating body has a tongue plate. The plurality of conductive terminals include a ground terminal and a signal terminal. Each of the ground terminal and the signal terminal includes a contact portion exposed on the tongue plate. The outer metal shell is provided with a mounting portion for being mounted to a circuit board. The shielding shell is in contact with the ground terminal, and the outer metal shell is in contact with the shielding shell. There is no need to provide any mounting part on the shielding shell to be directly mounted on the circuit board, thereby saving installation space and improving installation convenience.

20 Claims, 6 Drawing Sheets

ELECTRICAL CONNECTOR WITH IMPROVED SHIELDING EFFECT

CROSS-REFERENCE TO RELATED APPLICATION

This patent application claims priority of a Chinese Patent Application No. 202020136363.9, filed on Jan. 20, 2020 and titled "Electrical connector", the entire content of which is incorporated herein by reference.

TECHNICAL FIELD

The present disclosure relates to an electrical connector, which belongs to a technical field of connectors.

BACKGROUND

Existing electrical connectors usually include an insulating body, a plurality of conductive contacts fixed to the insulating body, and an outer metal shell located outside the insulating body. In addition, in order to further improve shielding effect, the existing electrical connectors are also provided with a shielding shell. As we all know, in order to achieve the purpose of shielding, the shielding shell and the outer metal shell shall be in contact with ground pins on a circuit board. For this reason, the shielding shell and the outer metal shell of the existing electrical connectors usually include a plurality of mounting parts respectively for being mounted to the circuit board. However, the existing design is complicated, takes up a lot of space, and is not facilitated for installation.

SUMMARY

An object of the present disclosure is to provide an electrical connector which has better shielding effect and is easy to be mounted to a circuit board.

In order to achieve the above object, the present disclosure adopts the following technical solution: an electrical connector comprising an insulating body having a tongue plate, a plurality of conductive terminals fixed to the insulating body, a shielding shell fixed to the insulating body, and an outer metal shell installed on a periphery of the insulating body. The plurality of conductive terminals include at least one ground terminal and at least one signal terminal. Each of the at least one ground terminal and the at least one signal terminal includes a contact portion exposed on the tongue plate. The outer metal shell is provided with a mounting portion for being mounted to a circuit board. The shielding shell is in contact with the at least one ground terminal, and the outer metal shell is in contact with the shielding shell.

Compared with the prior art, the shielding effect of the present disclosure is improved by providing the shielding shell and the outer metal shell, having the shielding shell be in contact with the ground terminal, and having the outer metal shell be in contact with the shielding shell. Besides, there is no need to provide any mounting part on the shielding shell to be directly mounted on the circuit board, thereby saving installation space and improving installation convenience.

DETAILED DESCRIPTION

Figure 1:
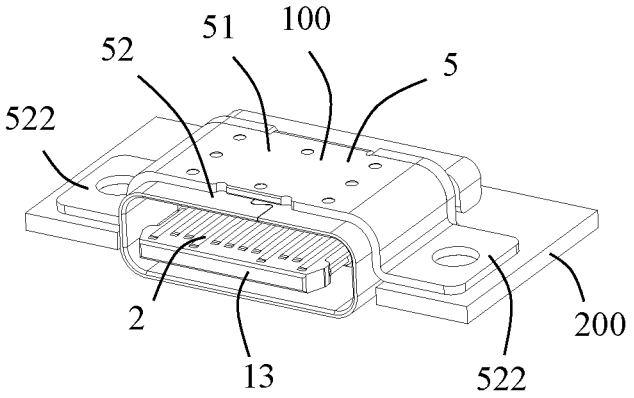
FIG. 1 is a schematic perspective view of an electrical connector in accordance with an embodiment of the present disclosure when the electrical connector is installed to a circuit board.
Figure 2:
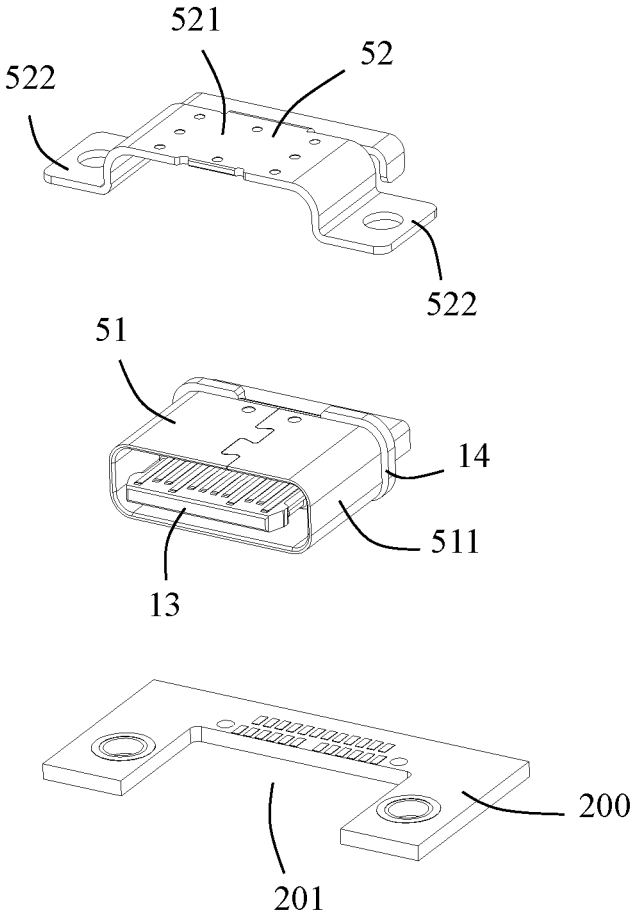
FIG. 2 is a partially exploded perspective view of FIG. 1.
Figure 3:
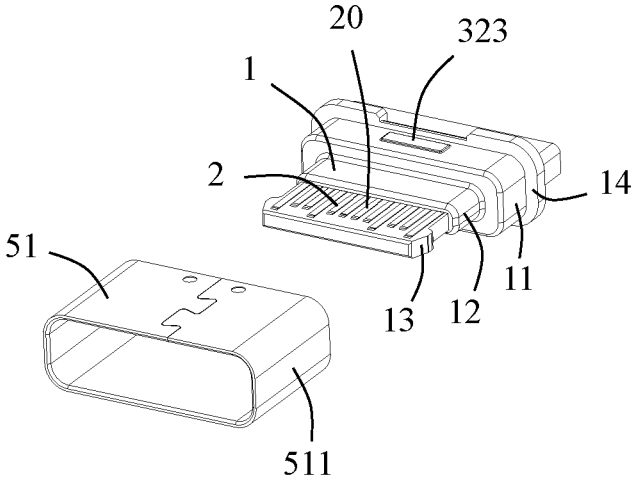
FIG. 3 is a schematic perspective view of a first shell and an insulating body as shown in FIG. 2 when they are separated.

Referring to FIGS. 1 to 6, the present disclosure discloses an electrical connector 100 for being mounted to a circuit board 200. The circuit board 200 is provided with an installation opening 201. The electrical connector 100 is partially installed in the installation opening 201. In an illustrated embodiment of the present disclosure, the electrical connector 100 is a Type C receptacle connector. Of course, in other embodiments, the electrical connector 100 may also be other type of connectors.

The electrical connector 100 includes an insulating body 1, a plurality of conductive terminals 2 fixed to the insulating body 1, a shielding shell 3 fixed to the insulating body 1, a shielding piece 4 fixed to the insulating body 1, and an outer metal shell 5 installed on a periphery of the insulating body 1.

The insulating body 1 includes a body portion 11, an extension portion 12 extending forwardly from the body portion 11, a tongue plate 13 extending forwardly from the extension portion 12, and a stopper 14 located at the rear of the body portion 11.

Figure 4:
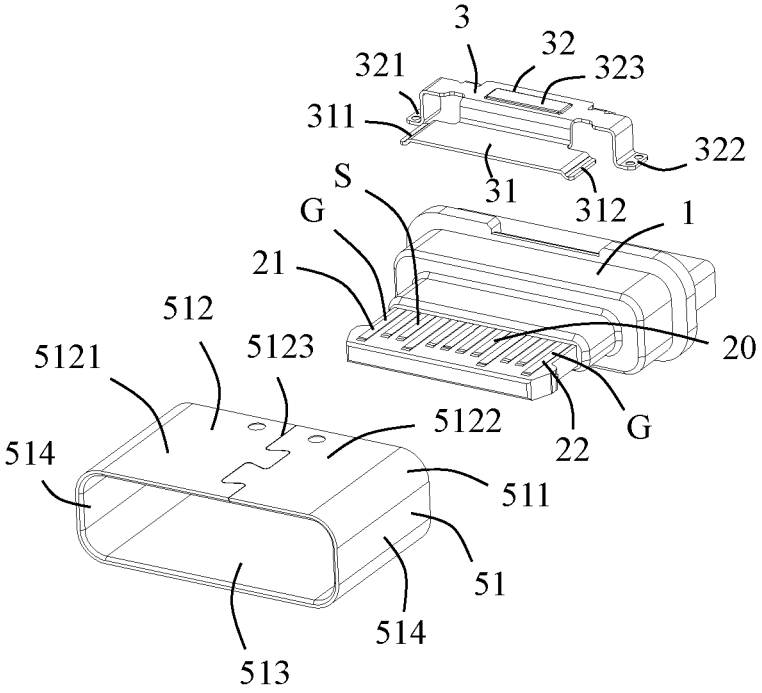
FIG. 4 is a further perspective exploded view of FIG. 3, in which a shielding shell is separated.
Figure 5:
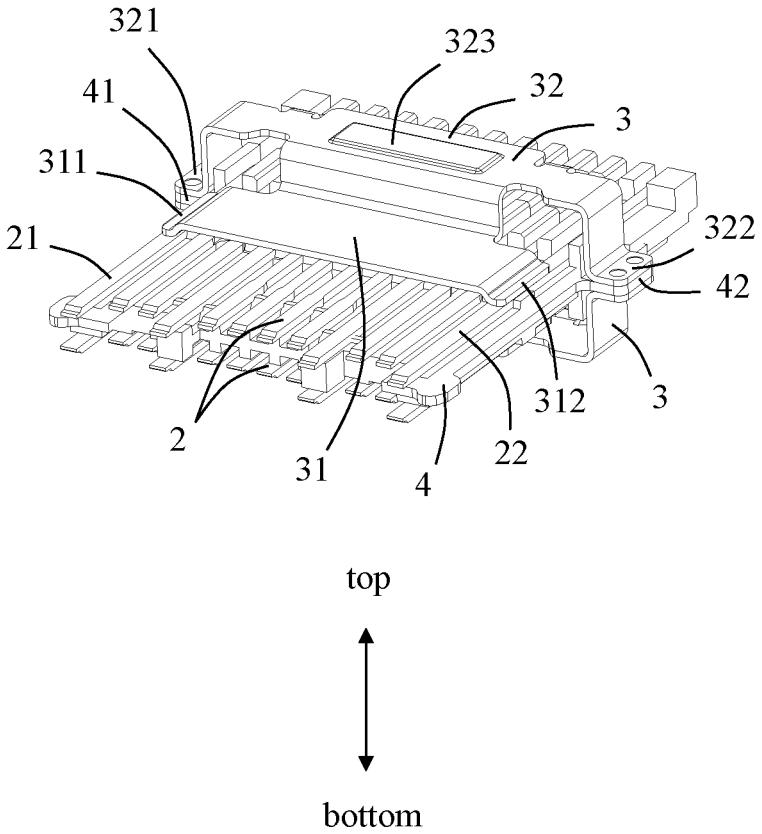
FIG. 5 is a schematic perspective view of the electrical connector of the present disclosure after the outer metal shell and the insulating body are removed.

Referring to FIG. 4, the plurality of conductive terminals 2 include a plurality of ground terminals G and a plurality of signal terminals S. Each of the ground terminals G and the signal terminals S includes a contact portion 20 exposed on the tongue plate 13. The ground terminals G include a first ground terminal 21 and a second ground terminal 22. The first ground terminal 21 and the second ground terminal 22 are respectively adjacent to two sides of the tongue plate 13. In the illustrated embodiment of the present disclosure, the conductive terminals 2 are insert-molded in the insulating body 1. Of course, in other embodiments, the conductive terminals 2 may also be assembled to the insulating body 1. Referring to FIG. 5, in the illustrated embodiment of the present disclosure, the plurality of conductive terminals 2 include an upper row of the conductive terminals 2 and a lower row of the conductive terminals 2.

Figure 6:
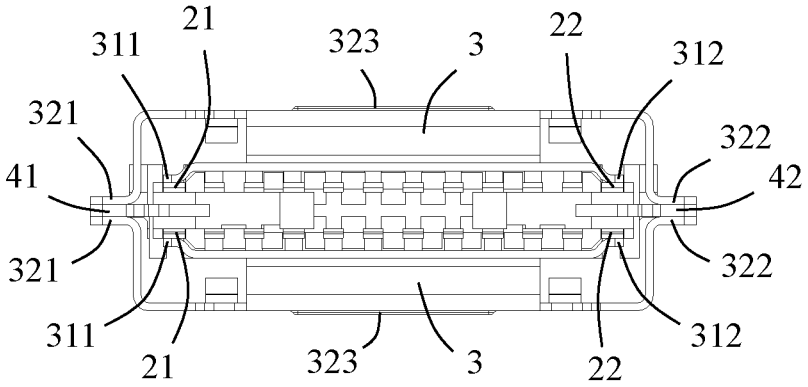
FIG. 6 is a front view of FIG. 5.

The shielding piece 4 is fixed in the tongue plate 13. In the illustrated embodiment of the present disclosure, the shielding piece 4 is insert-molded in the insulating body 1. Of course, in other embodiments, the shielding piece 4 may also be assembled to the tongue plate 13. The shielding piece 4 is located between the upper row of the conductive terminals 2 and the lower row of the conductive terminals 2 in order to improve the shielding effect. The shielding shell 3 and the shielding piece 4 are arranged separately, and the shielding shell 3 is in contact with the shielding piece 4. Referring to FIGS. 5 and 6, the shielding piece 4 is provided with a first protrusion 41 and a second protrusion 42 which protrude outwardly along a lateral direction.

The shielding shell 3 is provided with a first plate-shaped portion 31 which is insert-molded in the insulating body 1, and a first bent portion 311 and a second bent portion 312 which extend from two sides of the first plate-shaped portion 31, respectively. The first bent portion 311 is in contact with the first ground terminal 21. The second bent portion 312 is in contact with the second ground terminal 22. In an embodiment of the present disclosure, a contact position of the first bent portion 311 and the first ground terminal 21, and a contact position of the second bent portion 312 and the second ground terminal 22 are hidden in the insulating body 1. With this arrangement, the contact of the first bent portion 311 and the first ground terminal 21, and the contact of the second bent portion 312 and the second ground terminal 22 can be more stable at these contact positions.

Besides, the shielding shell 3 is further provided with a second plate-shaped portion 32 which is insert-molded in the insulating body 1, and a third bent portion 321 and a fourth bent portion 322 which extend from two sides of the second plate-shaped portion 32. The second plate-shaped portion 32 protrudes from the first plate-shaped portion 31 along a thickness direction (i.e., a top-to-bottom direction) of the insulating body 1. Referring to FIGS. 4 and 5, in the illustrated embodiment of the present disclosure, the second plate-shaped portion 32 of the shielding shell 3 at the upper side is higher than the first plate-shaped portion 31 so as to form a stepped portion. The third bent portion 321 is in contact with the first protrusion 41. The fourth bent portion 322 is in contact with the second protrusion 42. In order to ensure the reliability of contact, the third bent portion 321 and the first protrusion 41 may be welded together, for example, by spot welding. The fourth bent portion 322 and the second protrusion portion 42 may be welded together for example, by spot welding. The second plate portion 32 is provided with a raised portion 323 protruding beyond the insulating body 1. The raised portion 323 is welded and fixed to the outer metal shell 5. For example, the raised portion 323 and the outer metal shell 5 can be welded together by spot welding.

Referring to FIGS. 5 and 6, in the illustrated embodiment of the present disclosure, the two shielding shells 3 are symmetrically arranged on an upper side and a lower side of the tongue plate 13. It can be understood that at this time, the second plate-shaped portion 32 of the shielding shell 3 at the lower side is lower than the first plate-shaped portion 31 so as to form a stepped portion.

In the illustrated embodiment of the present disclosure, the outer metal shell 5 includes a first shell 51 and a second shell 52 which is fixed to the first shell 51 by welding. The first shell 51 includes a cylindrical portion 511 at least partially surrounding the insulating body 1. The cylindrical portion 511 has an upper surface 512, a lower surface 513 and two side surfaces 514 connecting the upper surface 512 and the lower surface 513. In the illustrated embodiment of the present disclosure, the cylindrical portion 511 is formed by bending a piece of metal shell. The upper surface 512 includes a first portion 5121, a second portion 5122 and a seam 5123 between the first portion 5121 and the second portion 5122. The raised portion 323 is respectively welded and fixed to the first portion 5121 and the second portion 5122. Through this arrangement, on the one hand, it realizes a reliable contact between the shielding shell 3 and the first shell 51; on the other hand, it can reduce the cracking risk of the seam 5123. The second shell 52 includes a top wall 521 shielded on the upper surface 512 and mounting portions 522 extending from two sides of the top wall 521. The top wall 521 is respectively welded and fixed to the first portion 5121 and the second portion 5122. By this arrangement, on the one hand, it realizes a reliable contact between the second shell 52 and the first shell 51; on the other hand, it can further reduce the cracking risk of the seam 5123. In assembling, the cylindrical portion 511 is sleeved on the body portion 11 and its rear end is restricted by the stopper 14. Of course, in other embodiments, the cylindrical portion 511 can also be integrally formed to improve the strength of the product and reduce the risk of cracking the port of the electrical connector.

Referring to FIG. 1, the mounting portions 522 are used for being mounted to the circuit board 200. In the illustrated embodiment of the present disclosure, the electrical connector 100 is mounted to the circuit board 200 in a sunk-in-board manner, that is, at least part of the outer metal shell 5 protrudes below the circuit board 200. With this arrangement, the installation height of the electrical connector 100 can be reduced.

Compared with the prior art, the shielding shell 3 of the present disclosure is in contact with the ground terminals G and the shielding piece 4, the shielding shell 3 is in contact with the first shell 51, and the first shell 51 is in contact with the second shell 52, and the second shell 52 is finally mounted to the circuit board 200 through the mounting portions 522. With this arrangement, the shielding shell 3 itself does not need to be provided any mounting portion to be directly mounted to the circuit board 200, thereby saving installation space and improving installation convenience.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

an insulating body comprising a tongue plate;

a plurality of conductive terminals fixed to the insulating body, the plurality of conductive terminals comprising at least one ground terminal and at least one signal terminal, each of the at least one ground terminal and the at least one signal terminal comprising a contact portion exposed on the tongue plate, the at least one ground terminal comprising a first upper ground terminal, a second upper ground terminal, a first lower ground terminal and a second lower ground terminal;

a shielding piece fixed in the tongue plate;

an upper shielding shell and a lower shielding shell which are fixed to the insulating body; and an outer metal shell installed on a periphery of the insulating body, the outer metal shell being provided with a mounting portion for being mounted to a circuit board;

wherein the outer metal shell is in contact with the upper shielding shell and/or the lower shielding shell;

wherein the upper shielding shell is provided with a first upper plate-shaped portion, a first upper bent portion, a second upper bent portion, a second upper plate-shaped portion, a third upper bent portion and a fourth upper bent portion; the first upper bent portion and the second upper bent portion are bent from opposite sides of the first upper plate-shaped portion, respectively; the third upper bent portion and the fourth upper bent portion are bent from opposite sides of the second upper plate-shaped portion, respectively;

wherein the lower shielding shell is provided with a first lower plate-shaped portion, a first lower bent portion, a second lower bent portion, a second lower plate-shaped portion, a third lower bent portion and a fourth lower bent portion; the first lower bent portion and the second lower bent portion are bent from opposite sides of the first lower plate-shaped portion, respectively; the third lower bent portion and the fourth lower bent portion are bent from opposite sides of the second lower plate-shaped portion, respectively;

wherein the first upper bent portion is in contact with the first upper ground terminal, the second upper bent portion is in contact with the second upper ground terminal, the first lower bent portion is in contact with the first lower ground terminal, and the second lower bent portion is in contact with the second lower ground terminal; and wherein the shielding piece comprises a first side which is sandwiched by the third upper bent portion and the third lower bent portion, and a second side which is sandwiched by the fourth upper bent portion and the fourth lower bent portion.

2. The electrical connector according to claim 1, wherein the shielding piece is arranged as a separate component from the upper shielding shell and the lower shielding shell.

3. The electrical connector according to claim 1, wherein the first upper ground terminal and the second upper ground terminal are located adjacent to two sides of the tongue plate, respectively; the first lower ground terminal and the second lower ground terminal are located adjacent to the two sides of the tongue plate, respectively; and the first upper plate-shaped portion and the first lower plate-shaped portion are insert-molded in the insulating body.

4. The electrical connector according to claim 3, wherein a contact position of the first upper bent portion and the first upper ground terminal, a contact position of the second upper bent portion and the second upper ground terminal, a contact position of the first lower bent portion and the first lower ground terminal, and a contact position of the second lower bent portion and the second lower ground terminal are hidden in the insulating body.

5. The electrical connector according to claim 3, wherein the shielding piece is provided with a first protrusion and a second protrusion which protrude outwardly; the second upper plate-shaped portion and the second lower plate-shaped portion are insert-molded in the insulating body; the second upper plate-shaped portion protrudes from the first upper plate-shaped portion along a thickness direction of the insulating body, the second lower plate-shaped portion protrudes from the first lower plate-shaped portion along the thickness direction of the insulating body, the first protrusion is sandwiched by the third upper bent portion and the third lower bent portion, and the second protrusion is sandwiched by the fourth upper bent portion and the fourth lower bent portion.

6. The electrical connector according to claim 5, wherein the second upper plate-shaped portion is provided with a raised portion protruding beyond the insulating body, and the raised portion is welded and fixed to the outer metal shell.

7. The electrical connector according to claim 6, wherein the outer metal shell comprises a first shell and a second shell welded and fixed to the first shell, the first shell comprises a cylindrical portion at least partially surrounding the insulating body, the cylindrical portion is provided with an upper surface, the raised portion is welded and fixed to the upper surface, the second shell is provided with a top wall shielded on the upper surface, the top wall and the upper surface are welded and fixed together.

8. The electrical connector according to claim 7, wherein the second shell further comprise another mounting portion, and the mounting portion and the another mounting portion extend from two sides of the top wall.

9. The electrical connector according to claim 5, wherein the third upper bent portion and the third lower bent portion are welded to the first protrusion, and the fourth upper bent portion and the fourth lower bent portion are welded to the second protrusion.

10. The electrical connector according to claim 1, wherein the upper shielding shell and the lower shielding shell are symmetrically arranged on an upper side and a lower side of the tongue plate, respectively.

11. An electrical connector, comprising:

an insulating body comprising a tongue plate;

a plurality of conductive terminals fixed to the insulating body, the plurality of conductive terminals comprising a first upper ground terminal, a second upper ground terminal, at least one upper signal terminal located between the first upper ground terminal and the second upper ground terminal, a first lower ground terminal, a second lower ground terminal, at least one lower signal terminal located between the first lower ground terminal and the second lower ground terminal, each of the first upper ground terminal, the second upper ground terminal and the at least one upper signal terminal comprising an upper contact portion exposed on an upper side of the tongue plate; each of the first lower ground terminal, the second lower ground terminal and the at least one lower signal terminal comprising a lower contact portion exposed on a lower side of the tongue plate;

a shielding piece fixed in the tongue plate;

a first shielding shell and a second shielding shell which are fixed to the insulating body, the first shielding shell is of a U-shaped configuration, and the second shielding shell is of a reversed U-shaped configuration; and an outer metal shell installed on a periphery of the insulating body, the outer metal shell being provided with a mounting portion for being mounted to a circuit board;

wherein the first shielding shell is in contact with the first upper ground terminal and the second upper ground terminal on the upper side, the second shielding shell is in contact with the first lower ground terminal and the second lower ground terminal on the lower side, and the outer metal shell is in contact with at least one of the first shielding shell and the second shielding shell;

wherein the first shielding shell is provided with a first upper plate-shaped portion, a first upper bent portion, a second upper bent portion, a second upper plate-shaped portion, a third upper bent portion and a fourth upper bent portion;

wherein the second shielding shell is provided with a first lower plate-shaped portion, a first lower bent portion, a second lower bent portion, a second lower plate-shaped portion, a third lower bent portion and a fourth lower bent portion;

wherein the first upper bent portion is in contact with the first upper ground terminal, the second upper bent portion is in contact with the second upper ground terminal, the first lower bent portion is in contact with the first lower ground terminal, and the second lower bent portion is in contact with the second lower ground terminal;

the shielding piece comprises a first side which is sandwiched by the third upper bent portion and the third lower bent portion, and a second side which is sandwiched by the fourth upper bent portion and the fourth lower bent portion.

12. The electrical connector according to claim 11, wherein the first shielding shell and the second shielding shell are symmetrically arranged on the upper side and the lower side of the tongue plate, respectively.

13. The electrical connector according to claim 11, wherein the first upper ground terminal and the second upper ground terminal are adjacent to two lateral sides of the tongue plate, respectively; and the first upper plate-shaped portion is insert-molded in the insulating body.

14. The electrical connector according to claim 13, wherein a contact position of the first upper bent portion and the first upper ground terminal, and a contact position of the second upper bent portion and the second upper ground terminal are hidden in the insulating body.

15. The electrical connector according to claim 13, wherein the first upper ground terminal, the second upper ground terminal and the at least one upper signal terminal being located on an upper side of the shielding piece, and the first lower ground terminal, the second lower ground terminal and the at least one lower signal terminal being located on a lower side of the shielding piece.

16. The electrical connector according to claim 11, wherein the shielding piece is provided with a first protrusion and a second protrusion which protrude outwardly; the first protrusion is sandwiched by the third upper bent portion and the third lower bent portion, and the second protrusion is sandwiched by the fourth upper bent portion and the fourth lower bent portion.

17. The electrical connector according to claim 11, wherein the second upper plate-shaped portion is provided with a raised portion protruding beyond the insulating body, and the raised portion is welded and fixed to the outer metal shell.

18. The electrical connector according to claim 17, wherein the outer metal shell comprises a first shell and a second shell welded and fixed to the first shell, the first shell comprises a cylindrical portion at least partially surrounding the insulating body, the cylindrical portion is provided with an upper surface, the raised portion is welded and fixed to the upper surface, the second shell is provided with a top wall shielded on the upper surface, the top wall and the upper surface are welded and fixed together.

19. The electrical connector according to claim 11, wherein the electrical connector is a Type C receptacle connector.

20. An electrical connector assembly, comprising:

a circuit board having a mounting opening; and an electrical connector mounted to the circuit board;

the electrical connector comprising:

an insulating body comprising a tongue plate;

a plurality of conductive terminals fixed to the insulating body, the plurality of conductive terminals comprising at least one ground terminal and at least one signal terminal, each of the at least one ground terminal and the at least one signal terminal comprising a contact portion exposed on the tongue plate, the at least one ground terminal comprising a first upper ground terminal, a second upper ground terminal, a first lower ground terminal and a second lower ground terminal;

a shielding piece fixed in the tongue plate;

an upper shielding shell and a lower shielding shell which are fixed to the insulating body; and an outer metal shell installed on a periphery of the insulating body, the outer metal shell being provided with a mounting portion for being mounted to the circuit board;

wherein the outer metal shell is in contact with the upper shielding shell and/or the lower shielding shell;

wherein the upper shielding shell is provided with a first upper bent portion, a second upper bent portion, a third upper bent portion and a fourth upper bent portion;

wherein the lower shielding shell is provided with a first lower bent portion, a second lower bent portion, a third lower bent portion and a fourth lower bent portion;

wherein the first upper bent portion is in contact with the first upper ground terminal, the second upper bent portion is in contact with the second upper ground terminal, the first lower bent portion is in contact with the first lower ground terminal, and the second lower bent portion is in contact with the second lower ground terminal;

the shielding piece comprises a first side which is sandwiched by the third upper bent portion and the third lower bent portion, and a second side which is sandwiched by the fourth upper bent portion and the fourth lower bent portion; and wherein the electrical connector is partially installed in the mounting opening, and at least part of the outer metal shell protrudes below the circuit board.

* * * * *